United States Patent [19]

Porter

[11] 4,379,446

[45] Apr. 12, 1983

[54] FAN ACCESSORY FOR HEATER

[76] Inventor: Donald G. Porter, 8620 Wilkinson Blvd., Charlotte, N.C. 28208

[21] Appl. No.: 400,398

[22] Filed: Jul. 21, 1982

Related U.S. Application Data

[63] Continuation-in-part of Ser. No. 365,594, Apr. 5, 1982.

[51] Int. Cl.[3] ..... F24H 3/02

[52] U.S. Cl. ..... 126/110 B; 165/124

[58] Field of Search ..... 126/110 R, 110 A, 110 B, 126/110 C, 110 D; 165/123, 124; 219/369, 372

[56] References Cited

U.S. PATENT DOCUMENTS

| | | | |
|---|---|---|---|
| 2,021,462 | 11/1935 | Panaro | 126/110 B |
| 2,173,073 | 9/1939 | Pierson | 126/110 B |
| 2,479,906 | 8/1949 | Cole | 126/110 B |
| 2,553,278 | 5/1951 | Rogant | 126/110 B |
| 2,633,070 | 3/1953 | Gillham | 165/124 |
| 2,740,579 | 4/1956 | Welsh | 126/110 B |
| 2,741,243 | 4/1956 | Jenson | 126/110 B |
| 2,834,279 | 5/1958 | Thompson | 126/110 B |
| 2,904,317 | 9/1959 | Copeland | 165/124 |
| 3,246,643 | 4/1966 | Stark | 126/110 B |
| 3,384,070 | 5/1968 | Castello | 126/110 B |

*Primary Examiner*—Daniel J. O'Connor

*Attorney, Agent, or Firm*—Bell, Seltzer, Park & Gibson

[57] ABSTRACT

A fan accessory for recovering heated air generated by a heater in which ambient and heated air are passed through a housing in separate passageways and wherein the ambient air flowing through its passageway provides an aspirating effect on the heated air to increase the flow of heated air through its passageway and out of the housing and to facilitate blending of the ambient and heated air outside the housing.

8 Claims, 4 Drawing Figures

FAN ACCESSORY FOR HEATER

This application is a continuation-in-part of my copending application Ser. No. 365,594, entitled FAN ACCESSORY FOR HEATER and filed Apr. 5, 1982.

The fan accessory of the instant invention is an improvement over that disclosed and claimed in my copending application, and is constructed to provide a considerably more efficient fan accessory for a heater.

In my earlier application the construction of the fan accessory is such that the ambient and heated air are blended within the housing of the fan accessory and prior to being directed out of the air outlet of the housing. While this arrangement provides a very compact and a relatively efficient fan accessory for heaters, it has been determined that very significant improvements can be effected thereover with very little additional attendant expense.

The primary object of this invention is to provide a fan accessory constructed to move the heat generated by a heater a further distance from the heater, and to more efficiently heat the space surrounding the heater.

This is broadly accomplished by providing the fan accessory with separate passageways for the flow of the heated and ambient air therethrough. No longer, as in my earlier application, are the ambient and heated air mixed and blended within the housing, but are now mixed and blended outside of the housing and over a greater distance extending outwardly from the housing. To accomplish this separate movement of the ambient and heated air flowing through the housing, a divider wall is positioned within the housing to isolate the flow of the ambient air from the flow of the heated air. The fan within the housing is positioned to cooperate with the ambient air passageway, and as the ambient air moves out of the housing, the presence of the divider wall causes the heated air to be subjected to an aspirating effect to increase the flow of the heated air out of the housing.

The arrangement of the divider wall within the housing which divides the housing into respective juxtaposed ambient and heated air passageways, is such that the ambient air passageway is convergingly arranged in the direction of air flow so as to provide a nozzle effect for enhancing the velocity of the ambient air and thereby increasing the aspirating effect on the adjacent heated air flowing out of the heated air passageway. Also, for aiding in movement of the heated air from the heated air passageway, the heated air passageway is divergingly arranged so that heated air is directed out of the air outlet of the housing even when the fan is off or inoperable.

It has been determined that positioning the divider wall to extend upwardly and forwardly from adjacent the fan means to the air outlet, as is preferred, and so illustrated in the drawings, serves to provide a barrier wall to isolate the fan and its motor from the heated air flowing through the heated air inlet and associated heated air passageway, to thereby protect the fan and its motor from excessive heat.

It has further been determined that, by forming the divider wall for the respective passageways of a heat conductive material, such as sheet metal, and which is preferred, the divider wall also serves as a heat sink for aiding in preheating the ambient air before the same is moved out of the housing and blended with the aspirated heated air flowing from the adjacent passageway.

BRIEF DESCRIPTION OF FIGURES

Some of the objects of the invention having been stated, other objects will appear as the description proceeds, when taken in connection with the accompanying drawings, in which—

DETAILED DESCRIPTION OF INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
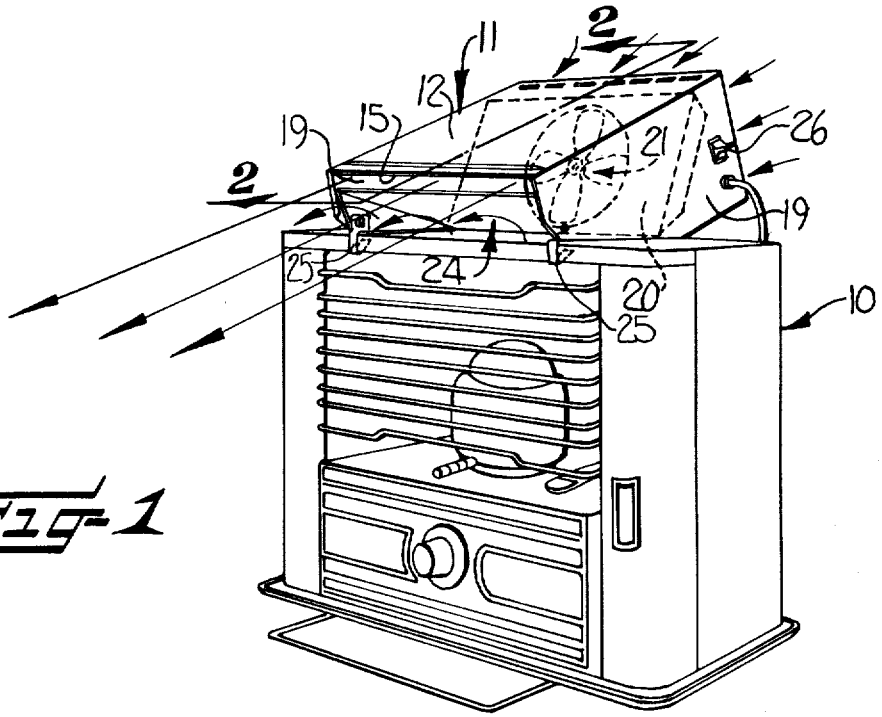
FIG. 1 is a perspective view of a heater and fan accessory in accordance with the present invention.

Referring now more particularly to FIG. 1, a heater of a known type is there generally indicated at 10. In the form shown, the heater 10 is of the kerosene fueled radiant type, housed in a generally rectangular housing, and is representative of a large number of heaters available from a variety of sources. As is known to persons of appropriate skill in the applicable arts, such heaters conventionally include a combustion chamber and have, in an upper surface of the housing, vent openings 10*a* through which air heated by the heater exits. Where the heater 10 is one designed primarily for radiant heating, the air flow is relatively small. Where the heater 10 is of a type primarily designed for convective heating, the air flow may be somewhat larger. The present invention contemplates that the fan accessory now to be described may be used with any of a large number of types of such heaters.

The fan accessory of the present invention comprises housing means, generally indicated at 11, for directing air flow. The housing means 11 for the fan accessory of the present invention has an upper wall 12, and a rear wall 14 (formed by a series of folded lips in the specific embodiment illustrated) defining a heated air inlet. The housing 11 additionally has a front portion, indicated at 15, defining an air outlet. In the form illustrated, the housing has a closure plate 16 which engages the rear wall 14 and cooperates therewith in closing a portion of the housing which is adjacent to a fan means described hereinafter and mounted within the housing. The plate 16 has a perforated wall 16*a* through which air may enter the ambient air inlet defined by the rear wall 14, as suggested by the arrows in FIGS. 1 and 2. The housing also has a lower wall 17 (formed by folded lips) which defines a heated air inlet, and side walls 19. The side walls form with the upper wall 12, rear wall 14, front portion 15 and lower wall 17 a prism having a pentagonal cross-section in a plane perpendicular to the upper and rear walls.

Within the housing means 11 is a transverse wall 20 which provides for the mounting of the fan means 21.

The fan means 21 includes an appropriate motive means such as an electrical motor 22 and a fan blade 23 driven by the motor 22. Preferably, the fan blade 23 is positioned within a circular opening in the wall 20, so as to partially shroud the fan and improve the air handling characteristics thereof. It will be noted that the fan means is angled or tilted in such a manner as to impinge the air against the upper wall 12 and produce turbulence, as illustrated by arrows in the drawing, for beneficial reasons to be explained more fully hereinafter.

Figure 2:
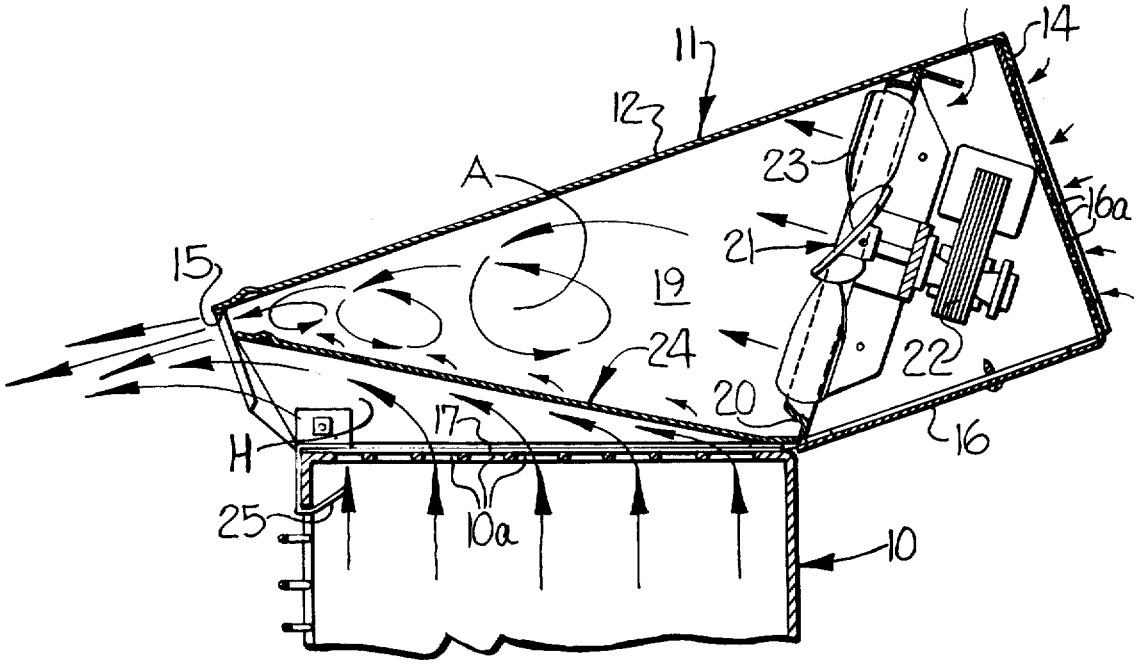
FIG. 2 is an enlarged sectional elevational view, taken generally along the line 2—2, of the fan accessory and a portion of the heater of FIG. 1.
Figure 3:
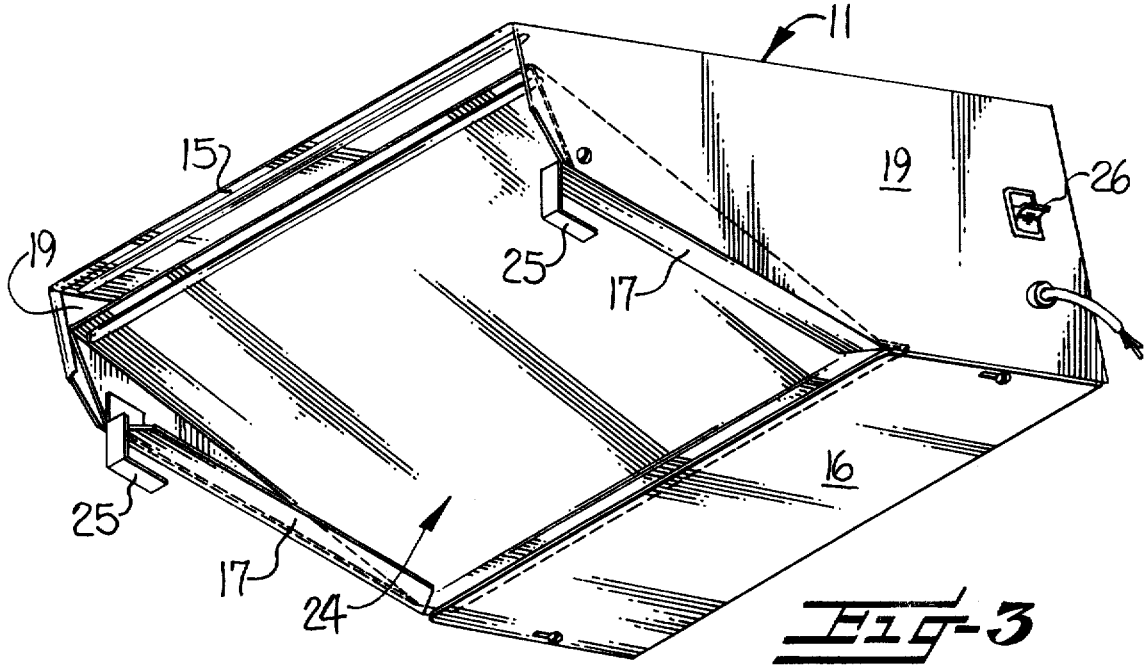
FIG. 3 is a perspective view, from below, of the fan accessory of FIGS. 1 and 2.
Figure 4:
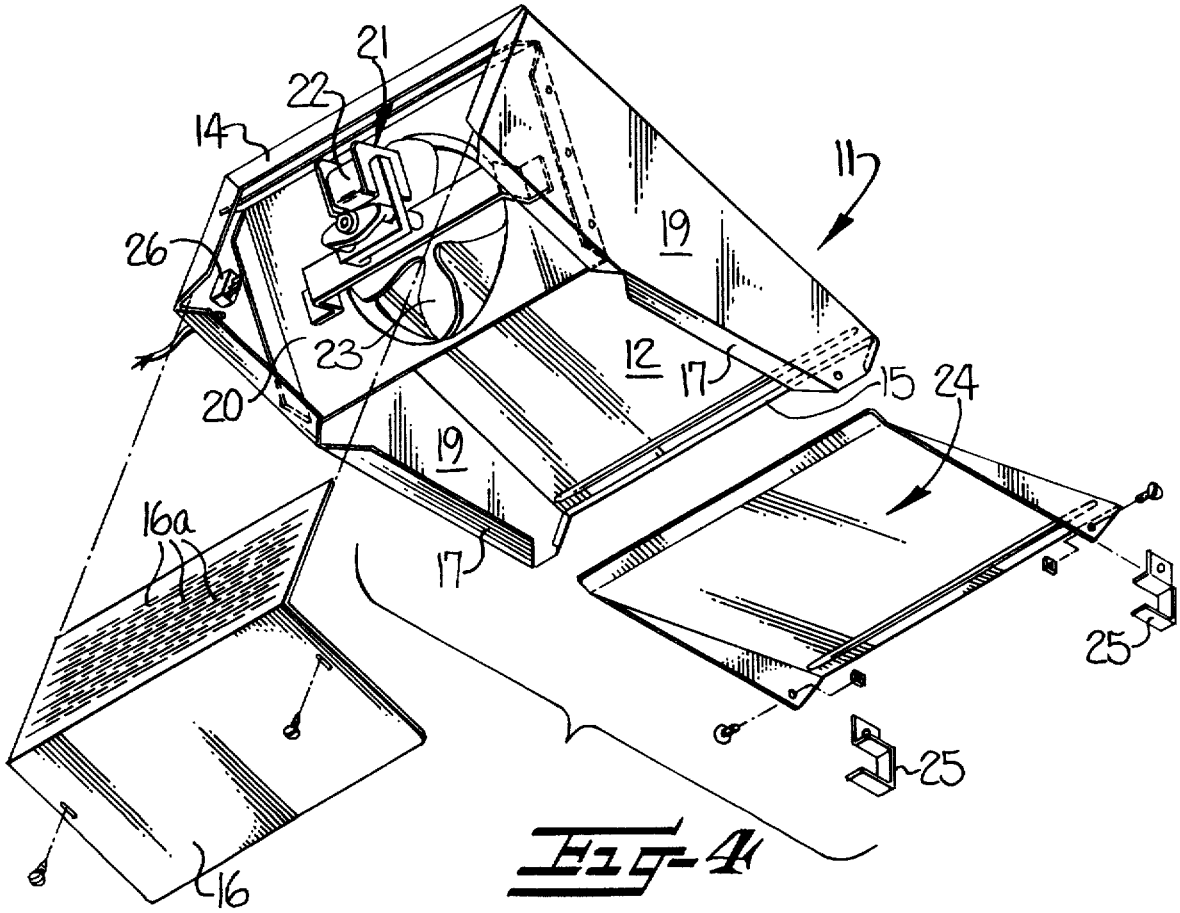
FIG. 4 is a partly exploded view of FIG. 3, but with the fan accessory reoriented 180°.

A divider wall 24 is provided within the housing means 11 and serves to divide the housing into an ambient air passageway A and a heated air passageway H as best illustrated in FIG. 2. As illustrated therein, this divider wall 24 is imperforate and extends across the full width of the housing and lengthwise from adjacent the fan means 21 upwardly and forwardly to adjacent the air outlet 15. This angled arrangement of the divider wall 24 provides an ambient air passageway A that is of a converging arrangement in the direction of air flow. On the other hand, this same angled arrangement of the divider wall 24 provides a diverging arrangement for the heated air passageway H in the direction of heated air flow.

Still referring to FIG. 2 of the drawings, it will be appreciated that the converging arrangement of the ambient air passageway serves for increasing the velocity of ambient air flow through the air outlet 15. This increased rate of flow serves to provide an aspirating effect with reference to the heated air within the heated air passageway H, and thus serves to induce more rapid movement and outward flow of the heated air from the heated air passageway H. Also, it will be understood that the blending of the ambient air with the heated air takes place at and outwardly beyond the air outlet and over a greater distance to provide more effective blending of the ambient and heated air and to also project the blended air a much greater distance from the heater means 10 to thus increase the overall efficiency of the operation.

For further increasing overall efficiency, it will be noted that the ambient air and heated air passageways are superimposed with the heated air passageway H being lowermost, thereby taking full advantage of the natural convective tendencies of warmer air to rise, thus additionally facilitating the desired blending of heated and ambient air adjacent the air outlet. It has been determined that when the heater means 10 is of the kerosene heater type, such as illustrated schematically in the drawings, that the burner unit can be set at a lower rate of fuel consumption due to the more effective dispersion and blending of the heated air outwardly beyond the heater by this fan accessory unit.

It has also been determined that the divider wall 24 by being arranged as described and illustrated in the drawings, serves as a heat barrier wall to isolate the fan and motor from the heater air flowing through the heater air inlet and into the heated air passageway. Thus this barrier divider wall serves to protect the fan and fan motor from excessive heat.

It is preferred that the divider wall 24 be formed of heat conductive material, such as sheet metal, to serve as a heat sink. In this arrangement the respective opposing faces of the divider wall are exposed to both the ambient and heated air flowing through the respective passageways of the housing, thus preheating the ambient air in its course of travel through its passageway.

Additionally, heater engaging means are provided on the housing means for positioning the fan accessory in operative association with a heater. In the specific form here illustrated, the heater engaging means takes the form of a pair of legs 25 adapted to clip onto an upper surface of the heater 10 (FIGS. 1 and 2). When so positioned, the heated air inlet defined by the lower wall 17 overlies the heated air vent openings conventionally provided at the upper surface of the heater 10.

In order to provide for adjustment of the heating effect accomplished and the recovery of heated air generated by the heater 10, it is preferred that the electrical motor 22 driving the fan blade 23 be supplied through a variable speed control such as a two speed switch 26 accessibly positioned in the side wall 19 of the housing 11. With such a variable speed control, the velocities of air flow may be adjusted in such a manner as to accomplish the inducement and blending of flow described hereinabove. Such inducement and blending of flow, as already mentioned, is further aided by the inclination of the interior wall 20 for mounting said fan means 21 (as illustrated particularly in FIG. 2), which results in the ambient air flow through the ambient air passageway A being impingingly directed against the upper wall 12 in the particular manner as indicated for creation of beneficial air turbulence.

In use, the fan accessory of the present invention may be associated with a heater of the general type described when it is desirable to improve the heating efficiency of such a heater by recovering heated air generated by the heater. In such use, the fan accessory is positioned with the heater engaging means as indicated in FIGS. 1 and 2, and the speed of the fan means is adjusted to induce, deliver and blend air flows as described.

In the drawings and specification, there has been set forth a preferred embodiment of the invention, and although specific terms are employed, they are used in a generic and descriptive sense only and not for purposes of limitation.

That which is claimed is:

1. Apparatus for heating occupied space such as a room within a building and comprising:

heater means for generating heat, and a fan accessory for recovering heated air generated by said heater means, said fan accessory comprising:

housing means for directing air flow and having an upper wall, a rear wall defining an ambient air inlet, a lower wall defining a heated air inlet, and a front portion defining an air outlet for ambient air and heated air, divider wall means extending within said housing means and cooperating therewith so as to define juxtaposed ambient and heated air passageways isolated from each other for separate flow of heated air and ambient air through said housing means and out of said air outlet, fan means cooperating with said ambient air passageway for inducing ambient air to enter said ambient air inlet and flow through said ambient air passageway and out of said air outlet, said divider wall means being so arranged relative to said housing means that the flow of ambient air out of the ambient air passageway causes an aspirating effect on the flow of heated air out of said air outlet by inducing the heated air to more rapidly move through said heated air passageway and to project further away from said housing means to thereby permit blending of the ambient and heated air to take place over a greater distance from said housing means and to provide a more efficient operation of the heater means, and heater engaging means on said housing means for positioning said housing means on said heater means to receive through said heated air inlet, heated air generated by said heater means.

2. Apparatus for heating occupied space such as a room within a building and comprising:

heater means for generating heat, and a fan accessory for recovering heated air generated by said heater means, said fan accessory comprising:

housing means for directing air flow and having an upper wall, a rear wall defining an ambient air inlet, a lower wall defining a heated air inlet, and a front portion defining an air outlet for ambient air and heated air, divider wall means extending within said housing means and cooperating therewith so as to define respective upper and lower juxtaposed ambient and heated air passageways isolated from each other for separate flow of heated air and ambient air through said housing means and out of said air outlet, said divider wall means being so arranged with said upper wall of said housing that the ambient air passageway is convergingly arranged in the direction of air flow to accelerate the movement of the ambient air passing through said air outlet, and said divider wall means being so arranged relative to said lower wall of said housing means that the heated air passageway is divergingly arranged in the direction of air flow so as to facilitate movement of heated air passing through said air outlet, fan means cooperating with said ambient air passageway for inducing ambient air to enter said ambient air inlet and flow through said ambient air passageway and out of said air outlet, said divider wall means being so arranged relative to said housing means that the flow of ambient air out of the ambient air passageway causes an aspirating effect on the flow of heated air out of said air outlet by inducing the heated air to more rapidly move through said heated air passageway and to project further away from said housing means to thereby permit blending of the ambient and heated air to take place over a greater distance from said housing means to provide a more efficient operation of the heater means, and heater engaging means on said housing means for positioning said housing means on said heater means to receive through said heated air inlet, heated air generated by said heater means.

3. A fan accessory for recovering heated air generated by a heater and comprising:

housing means for directing air flow and having an upper wall, a rear wall defining an ambient air inlet, a lower wall defining a heated air inlet, and a front portion defining an air outlet for ambient air and heated air, divider wall means extending within said housing means and cooperating therewith so as to define juxtaposed ambient and heated air passageways isolated from each other for separate flow of heated air and ambient air through said housing means and out of said air outlet, fan means cooperating with said ambient air passageway for inducing ambient air to enter said ambient air inlet and flow through said ambient air passageway and out of said air outlet, said divider wall means being so arranged relative to said housing means that the flow of ambient air out of the ambient air passageway causes an aspirating effect on the flow of heated air out of said air outlet by inducing the heated air to more rapidly move through said heated air passageway and to project further away from said housing means to thereby permit blending of the ambient and heated air to take place over a greater distance from said housing means and to provide a more efficient operation of a heater, and heater engaging means on said housing means for positioning said housing means to receive through said heated air inlet, heated air generated by a heater.

4. Apparatus according to either claim 1 or 3 wherein said ambient air passageway is positioned above said heated air passageway and wherein said upper wall of said housing means defines the upper extent of said ambient air passageway, and said fan means being positioned within the confines of said ambient air passageway and being so mounted therewithin that the air impelled by said fan means impingingly engages the upper wall of said housing so as to impart turbulence to such ambient air for enhanced mixing of the ambient air with the heated air outwardly beyond said air outlet.

5. Apparatus according to either claim 1 or 3 wherein said divider wall means extends upwardly and forwardly from adjacent said fan means to said air outlet and serves as a barrier wall to isolate the fan from the heated air flowing through said heated air inlet and heated air passageway to thereby protect the fan from excessive heat.

6. Apparatus according to either claim 1 or 3 wherein said divider wall means is formed of heat conductive sheet material with respective opposing faces thereof being exposed to said ambient and heated air passageways and serving to absorb heat from the heated air so that ambient air may be preheated in its course of travel through said ambient air passageway.

7. A fan accessory for recovering heated air generated by a heater and comprising:

housing means for directing air flow and having an upper wall, a rear wall defining an ambient air inlet, a lower wall defining a heated air inlet, and a front portion defining an air outlet for ambient air and heated air, divider wall means extending within said housing means and cooperating therewith so as to define respective upper and lower juxtaposed ambient and heated air passageways isolated from each other for separate flow of heated air and ambient air through said housing means and out of said air outlet, fan means cooperating with said ambient air passageway for inducing ambient air to enter said ambient air inlet and flow through said ambient air passageway and out of said air outlet, said divider wall means being convergingly arranged relative to said upper wall of said housing means so that the flow of ambient air out of the ambient air passageway causes the ambient air to accelerate and to provide an aspirating effect on the flow of heated air out of said air outlet by inducing the heated air to more rapidly move through said heated air passageway and to project further away from said housing means to thereby permit blending of the ambient and heated air to take place over a greater distance from said housing means to provide a more efficient operation of a heater, and heater engaging means on said housing means for positioning said housing means to receive through said heated air inlet, heated air generated by a heater.

8. A fan accessory for recovering heated air generated by a heater and comprising:

housing means for directing air flow and having an upper wall, a rear wall defining an ambient air inlet, a lower wall defining a heated air inlet, and a front portion defining an air outlet for ambient air and heated air, divider wall means extending within said housing means and cooperating therewith so as to define respective upper and lower juxtaposed ambient and heated air passageways isolated from each other for separate flow of heated air and ambient air through said housing means and out of said air outlet, said divider wall means being so arranged with said upper wall of said housing that the ambient air passageway is converingly arranged in the direction of air flow to accelerate the movement of the ambient air passing through said air outlet, and said divider wall means being so arranged relative to said lower wall of said housing that the heated air passageway is divergingly arranged in the direction of air flow so as to facilitate movement of heated air passing through said air outlet, fan means cooperating with said ambient air passageway for inducing ambient air to enter said ambient air inlet and flow through said ambient air passageway and out of said air outlet, said divider wall means being so arranged relative to said housing means that the flow of ambient air out of the ambient air passageway causes an aspirating effect on the flow of heated air out of said air outlet by inducing the heated air to more rapidly move through said heated air passageway and to project further away from said housing means to thereby permit blending of the ambient and heated air to take place over a greater distance from said housing means and to provide a more efficient operation of the heater, and heater engaging means on said housing means for positioning said housing to receive through said heated air inlet, heated air generated by a heater.

* * * * *